US009522553B2

(12) United States Patent
Shinagawa

(10) Patent No.: US 9,522,553 B2
(45) Date of Patent: Dec. 20, 2016

(54) SHEET CONVEYANCE APPARATUS, PRINTING APPARATUS, CONTROL METHOD FOR SHEET CONVEYANCE APPARATUS, AND COMPUTER READABLE STORAGE MEDIUM

(71) Applicant: CANON KABUSHIKI KAISHA, Tokyo (JP)

(72) Inventor: Kazutaka Shinagawa, Yokohama (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 14/673,658

(22) Filed: Mar. 30, 2015

(65) Prior Publication Data

US 2015/0273900 A1 Oct. 1, 2015

(30) Foreign Application Priority Data

Mar. 31, 2014 (JP) ..... 2014-074580

(51) Int. Cl.
*B41J 29/393* (2006.01)
*B41J 13/00* (2006.01)
*B65H 7/02* (2006.01)

(52) U.S. Cl.
CPC ..... *B41J 13/0027* (2013.01); *B41J 13/0054* (2013.01); *B65H 7/02* (2013.01); *B65H 2511/10* (2013.01); *B65H 2511/22* (2013.01); *B65H 2511/414* (2013.01); *B65H 2511/415* (2013.01)

(58) Field of Classification Search
CPC ..... B41J 3/0009; B41J 15/04; B41J 11/0095; B41J 11/42; B41J 13/0054; B41J 13/103
USPC ..... 347/16, 19, 105
See application file for complete search history.

(56) References Cited

U.S. PATENT DOCUMENTS 8,366,229 B2 * 2/2013 Kuczynski ..... G06F 3/1293 347/1
9,004,673 B2 * 4/2015 Hakamata ..... B41J 11/485 347/105
9,028,033 B2 * 5/2015 Matsuoka ..... B41J 11/0095 347/16

FOREIGN PATENT DOCUMENTS

JP 2012-245649 A 12/2012

* cited by examiner

*Primary Examiner* — Lamson Nguyen
(74) *Attorney, Agent, or Firm* — Canon USA, Inc. IP Division

(57) ABSTRACT

A sheet conveyance apparatus includes a convey unit, an obtaining unit, a determining unit, and a control unit. The convey unit conveys sheets. The obtaining unit obtains attribute information about sheets used in a job. The determining unit determines a first interval and a second interval. The first interval is an interval between sheets that are conveyed by the convey unit in a case where the attribute information about the sheets obtained by the obtaining unit is first attribute information. The second interval is an interval between sheets that are conveyed by the convey unit in a case where the attribute information about the sheets obtained by the obtaining unit is second attribute information that is different from the first attribute information. The control unit performs control to make the convey unit convey sheets at the interval between sheets determined by the determining unit.

19 Claims, 15 Drawing Sheets

FIG. 3

| | NORMAL PRINT MODE | INITIAL PRODUCTION PRIORITY MODE | CONSTANT PRODUCTION MODE |
|---|---|---|---|
| SUPPORTED SHEET TYPES | MANY | FEW (LIMITED SHEET TYPES) | |
| PRINT SPEED | VARIABLE | | CONSTANT |
| TARGET TEMPERATURE OF CENTER OF SHEET PASSING PORTION | HIGH | MEDIUM | LOW |
| INITIAL PRODUCTIVITY | LOW (DECREASES WHILE PRINTING ON SEVERAL SHEETS) | HIGH | MEDIUM |
| TOTAL PRODUCTIVITY IN CASE OF HIGH-VOLUME PRINTING | LOW | MEDIUM | HIGH |

FIG. 5

| | MODE 1 | MODE 2 | MODE 3 | · · · | MODE 10 |
|---|---|---|---|---|---|
| PRINT SPEED (PPM) | 20.0 | 17.0 | 15.7 | · · · | 5.1 |
| PROCESS SPEED | HALF SPEED | | | | |
| INTERVAL BETWEEN SHEETS (s) | 1.0 | 1.15 | 1.30 | · · · | 4.0 |
| TARGET TEMPERATURE OF CENTER OF SHEET PASSING PORTION (°C) | 140 | | | | |

FIG. 8

| | | | |
|---|---|---|---|
| . . . | | . . . | |
| BUSINESS FORM 1 | WIDTH (mm) | 76.2 | 801 |
| | HEIGHT (mm) | 127.0 | 802 |
| | PRINT MODE | MODE 1 | 803 |
| BUSINESS FORM 2 | WIDTH (mm) | 312.0 | |
| | HEIGHT (mm) | 470.0 | |
| | PRINT MODE | OFF | |
| BUSINESS FORM 3 | WIDTH (mm) | 100.0 | |
| | HEIGHT (mm) | 200.0 | |
| | PRINT MODE | MODE 10 | |
| FREE SIZE PRINT MODE | | MODE 6 | 804 |
| BUSINESS FORM PRINT SPEED IMPROVEMENT SETTING | | LOW-VOLUME PRINT SPEED IMPROVEMENT MODE (INITIAL PRODUCTION PRIORITY MODE) | 805 |
| . . . | | . . . | |

SHEET CONVEYANCE APPARATUS, PRINTING APPARATUS, CONTROL METHOD FOR SHEET CONVEYANCE APPARATUS, AND COMPUTER READABLE STORAGE MEDIUM

BACKGROUND OF THE INVENTION

Field of the Invention

The present invention relates to a sheet conveyance apparatus, a printing apparatus, a control method for a sheet conveyance apparatus, and a computer readable storage medium.

Description of the Related Art

Printers that have a plurality of print modes and that perform printing by selecting an appropriate print mode depending on the situation at the time of printing are available. There is a technique that appropriately controls, in a case of performing a plurality of print jobs, switching of the print speed so as to reduce the total print time by taking into consideration a print speed to be applied to each print job and a time taken to switch the print speed for each print job (see Japanese Patent Laid-Open No. 2012-245649).

As sheets used in printing, there are available sheets called "narrow-width sheets", such as business forms, for example, which have a narrower width and a longer length than typical print sheets. When high-volume printing is performed using such narrow-width sheets, the temperature of the end portion of the fixing unit over which the sheets do not pass surges, which often results in failure in continuous printing. On the other hand, a mode called "constant production mode" is available in which it is possible to keep the print speed constant from the start of printing until the end of printing by making the temperature of the fixing heater lower than usual and making the sheet conveyance speed slower than usual in a case of printing using narrow-width sheets.

In a system in which a print job is transmitted from a personal computer (PC) to a printer to thereby perform printing, a method as described below has been employed in a case of using the constant production mode. Specifically, a method has been employed in which a user registers in advance, on the printer, a setting of the constant production mode and the like, and the user specifies, on the PC via a driver, whether or not to use the constant production mode when performing printing.

However, it is difficult to use the constant production mode in the existing method in a case where a plurality of types of narrow-wide sheets are used. Specifically, a user needs to register again, on the printer, a setting of the constant production mode and the like each time the type of business form to be used changes, which complicates user operation.

SUMMARY OF THE INVENTION

According to an aspect of the present invention, a sheet conveyance apparatus includes a convey unit configured to convey sheets, an obtaining unit configured to obtain attribute information about sheets used in a job, a determining unit configured to determine a first interval and a second interval, wherein the first interval is an interval between sheets that are conveyed by the convey unit in a case where the attribute information about the sheets obtained by the obtaining unit is first attribute information, and wherein the second interval is an interval between sheets that are conveyed by the convey unit in a case where the attribute information about the sheets obtained by the obtaining unit is second attribute information that is different from the first attribute information, and a control unit configured to perform control to make the convey unit convey sheets at the interval between sheets determined by the determining unit.

Further features of the present invention will become apparent from the following description of exemplary embodiments with reference to the attached drawings.

BRIEF DESCRIPTION OF THE DRAWINGS

FIG. 3 is a table indicating characteristics of each print mode.

FIG. 5 is a table indicating characteristics of further detailed modes of a constant production mode.

FIG. 8 illustrates a list of settings stored in the printer.

DESCRIPTION OF THE EMBODIMENTS

First Embodiment

Print System

Figure 1:
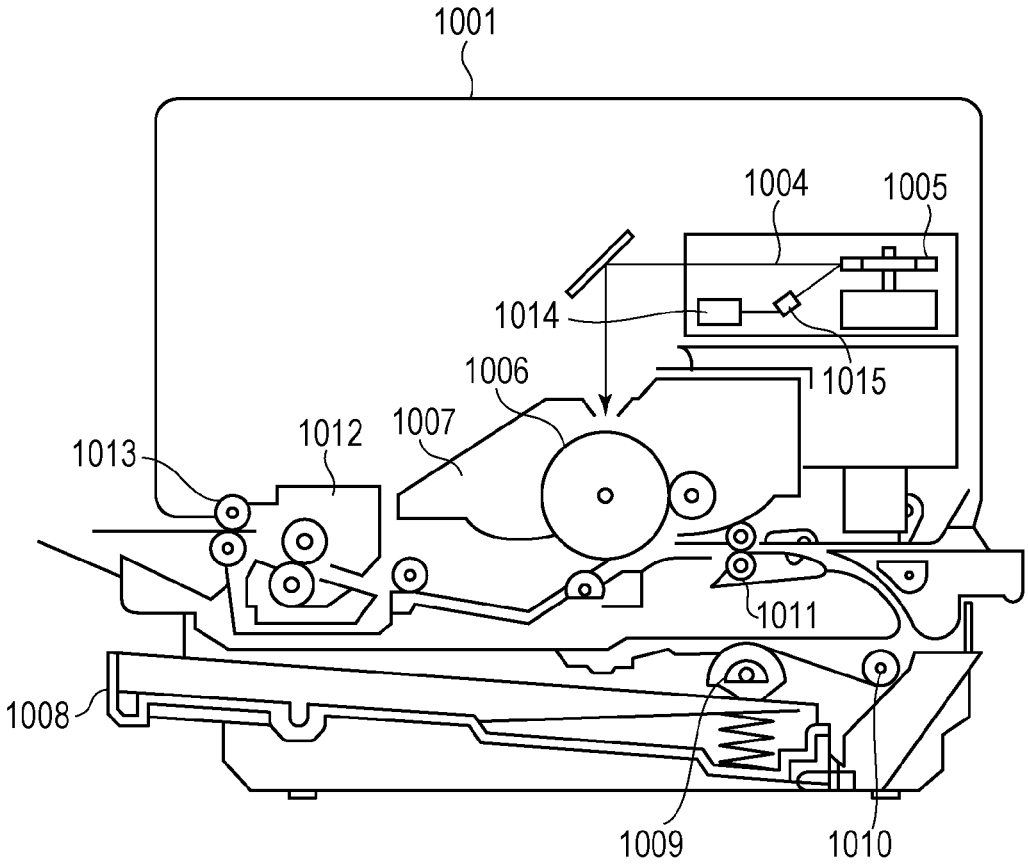
FIG. 1 is a cross-sectional view of a printer.

FIG. 1 is a cross-sectional view of a printer 1001.

A laser driver 1014 converts print data into a video signal and outputs the video signal.

A semiconductor laser 1015 emits a laser beam 1004 in accordance with the video signal input from the laser driver 1014.

The laser beam 1004 is emitted from the semiconductor laser 1015.

A rotating polygon mirror 1005 reflects the laser beam 1004 in a main scan direction.

A photosensitive member 1006 is exposed to and scanned by the laser beam 1004 that is reflected by the rotating polygon mirror 1005 in the main scan direction. As a result, an electrostatic latent image of an output image is formed on the photosensitive member 1006.

A developing unit 1007 develops the electrostatic latent image of the output image formed on the photosensitive member 1006. The output image is thereafter transferred from the photosensitive member 1006 onto a sheet.

A sheet cassette 1008 stores sheets therein.

A feeding roller 1009 feeds sheets stored in the sheet cassette 1008.

A conveying roller 1010 and a registration roller 1011 convey sheets fed by the feeding roller 1009 to the photosensitive member 1006. The sheet conveyance speed is adjusted by controlling the rotation speeds of the conveying roller 1010 and the registration roller 1011.

A fixing unit 1012 includes a heater, and fixes the output image transferred onto a sheet by pressurized heating. The fixing unit 1012 includes a sensor that senses the temperature of the end portion of a fixing roller and detects an end portion temperature rise when the temperature increases to a preset value or higher. The fixing unit 1012 further includes a sensor that senses the temperature of the center of a sheet passing portion and that performs control so as to keep the temperature at a predetermined value.

A discharge roller 1013 discharges a sheet on which the output image has been fixed by the fixing unit 1012.

Figure 2:
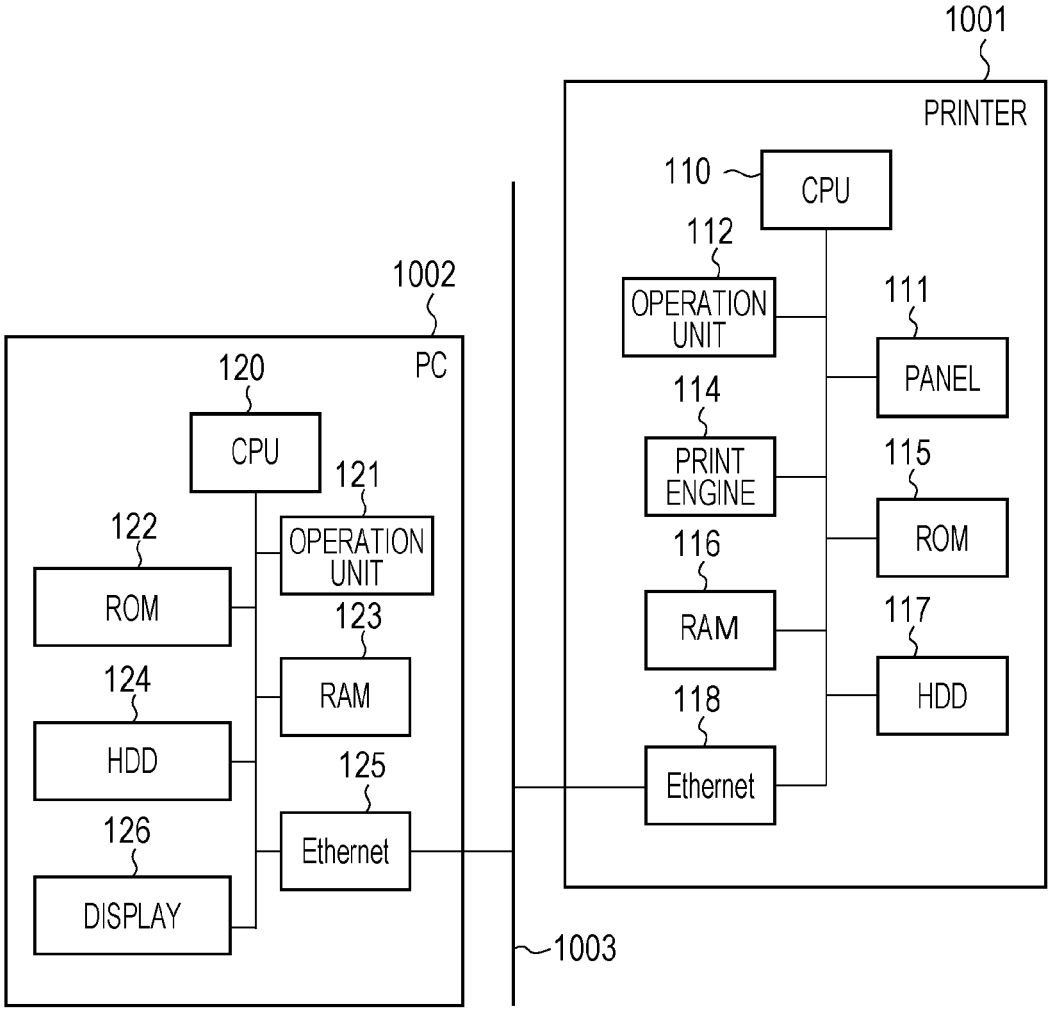
FIG. 2 is a block diagram illustrating a configuration of the printer and a PC.

FIG. 2 is a block diagram illustrating a configuration of the printer 1001 and a PC 1002.

The printer 1001 and the PC 1002 are connected with each other via a local area network (LAN) 1003 so as to enable communication.

The printer 1001 is an example of a printing apparatus (image forming apparatus), and has a configuration as described below.

A central processing unit (CPU) 110 performs overall control of the printer 1001.

A panel 111 displays various types of information to a user.

An operation unit 112 accepts various operations from a user.

A print engine 114 forms an image on a sheet.

A read-only memory (ROM) 115 stores a boot program, a control program, and the like of the printer 1001 therein. If a rewritable storage medium, such as a flash memory, is used as the ROM 115, it is possible to update various programs at any time.

A random access memory (RAM) 116 functions as a work memory of the CPU 110. The various programs stored in the ROM 115 are loaded into the RAM 116, and various types of data, such as print data, is temporarily stored in the RAM 116.

A hard disk drive (HDD) 117 temporarily stores raster data when image forming is performed, and also saves various preset values therein.

An Ethernet (registered trademark) unit 118 is connected to the LAN 1003, and transmits/receives data to/from the PC 1002.

The PC 1002 is an example of an information processing apparatus, and has a configuration as described above.

A CPU 120 performs overall control of the PC 1002.

An operation unit 121 accepts various operations from a user.

A ROM 122 stores a boot program, a control program, and the like of the PC 1002 therein.

A RAM 123 functions as a work memory of the CPU 120. Various programs stored in the ROM 122 are loaded into the RAM 123, and various types of data, such as print data, is temporarily stored in the RAM 123.

An HDD 124 stores data, an application program, and the like used by the CPU 120 therein.

An Ethernet unit 125 is connected to the LAN 1003, and transmits/receives data to/from the printer 1001.

A display 126 displays various types of information to a user.

Print Modes

FIG. 3 is a table indicating characteristics of each print mode.

In this embodiment, a normal print mode, a low-volume print speed improvement mode (initial production priority mode), and a high-volume print speed improvement mode (constant production mode) are available as print modes. The normal print mode is a print mode used in printing on typical, standard-size sheets. The low-volume print speed improvement mode (initial production priority mode) and the high-volume print speed improvement mode (constant production mode) are print modes used in printing on nonstandard-size sheets called narrow-width sheets, such as business forms, and are print modes for reducing an end portion temperature rise in the fixing unit, which may occur at the time of printing.

Regarding the supported sheet types, various standard-size sheets, such as A4 size sheets and A3 size sheets, are able to be supported in the normal print mode. On the other hand, the low-volume print speed improvement mode (initial production priority mode) and the high-volume print speed improvement mode (constant production mode) are tailored to support business forms (forms having an extremely narrow width relative to the width of the fixing unit).

Regarding the print speed, in the normal print mode and the low-volume print speed improvement mode (initial production priority mode), the print speed decreases as the temperature of the fixing unit increases. The print speed is adjusted by changing the interval between sheets while keeping the process speed constant. On the other hand, in the high-volume print speed improvement mode (constant production mode), the print speed is always kept constant. Accordingly, comparing the low-volume print speed improvement mode (initial production priority mode) with the high-volume print speed improvement mode (constant production mode) reveals the following. The print speed is relatively high in the low-volume print speed improvement mode (initial production priority mode) as long as the number of printed sheets is small; however, the print speed is relatively high in the high-volume print speed improvement mode (constant production mode) if the number of printed sheets increases.

The target temperature of the center of the sheet passing portion is kept lower in the low-volume print speed improvement mode (initial production priority mode) and in the high-volume print speed improvement mode (constant production mode) than in the normal print mode in order to suppress the occurrence of an end portion temperature rise (a state where it is no longer possible to continue printing because the temperature of the fixing unit exceeds a threshold) due to a temperature rise in the end portion of the fixing unit (a state where the temperature of the end portion over which sheets do not pass increases) when printing on business forms is performed. For a similar reason, the target temperature of the center of the sheet passing portion is kept lower in the high-volume print speed improvement mode (constant production mode) in which the print speed is constant than in the low-volume print speed improvement mode (initial production priority mode) in which the print speed is variable.

The initial productivity is higher in the low-volume print speed improvement mode (initial production priority mode) than in the high-volume print speed improvement mode (constant production mode). Note that, in the normal print mode, printing is stopped due to an occurrence of an end portion temperature rise while printing on several sheets, and therefore, the initial productivity is extremely low.

The total productivity in a case of high-volume printing is higher in the high-volume print speed improvement mode (constant production mode) than in the low-volume print speed improvement mode (initial production priority mode). The relationship between the productivity in the low-volume print speed improvement mode (initial production priority mode) and that in the high-volume print speed improvement mode (constant production mode) is reversed when the number of printed sheets increases to some extent from the point at which the curves that represent productivity in the respective modes intersect (at a point in time at which the area between the curves before the point of intersection becomes equal to that after the point of intersection). In the normal print mode, printing is stopped due to an occurrence of an end portion temperature rise while printing on several sheets, as described above, and therefore, the total productivity in the case of high-volume printing is also extremely low.

Figure 4A:
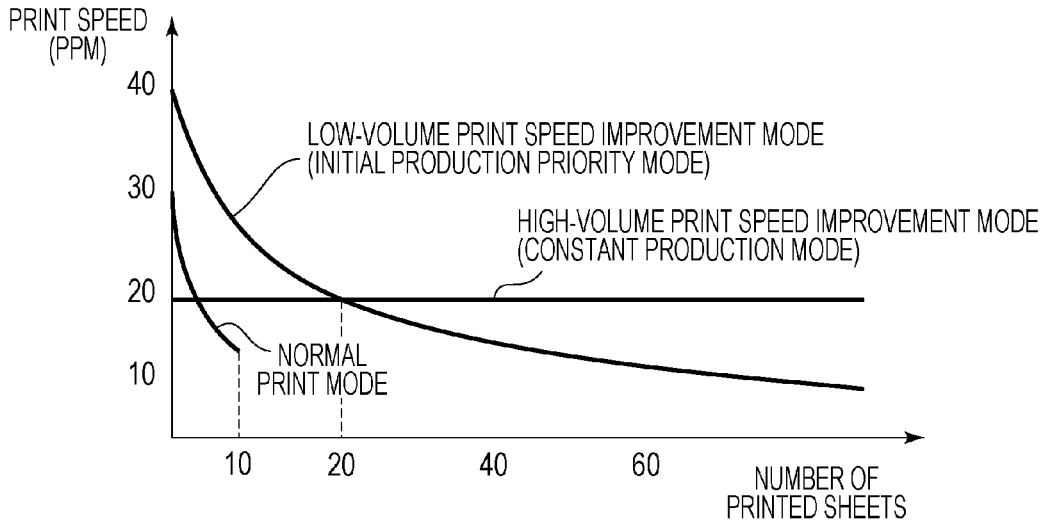
FIG. 4A is a graph indicating changes in the print speed in each print mode in a case of printing on business forms.

FIG. 4A is a graph indicating changes in the print speed in each print mode in a case of printing on business forms.

In FIG. 4A, the horizontal axis represents the number of printed sheets, and the vertical axis represents the print speed.

In the normal print mode, printing is stopped due to an occurrence of an end portion temperature rise while printing on several sheets (10 sheets in FIG. 4A).

In the low-volume print speed improvement mode (initial production priority mode), the print speed gradually decreases as the number of printed sheets increases. The print speed in the low-volume print speed improvement mode (initial production priority mode) is higher than that in the high-volume print speed improvement mode (constant production mode) until the number of printed sheets reaches a specific number of sheets (20 sheets in FIG. 4A), but is lower than that in the high-volume print speed improvement mode (constant production mode) if the number of printed sheets exceeds the specific number of sheets (20 sheets in FIG. 4A).

In the high-volume print speed improvement mode (constant production mode), the print speed is constant regardless of the number of printed sheets. The print speed in the high-volume print speed improvement mode (constant production mode) is lower than that in the low-volume print speed improvement mode (initial production priority mode) until the number of printed sheets reaches the specific number of sheets (20 sheets in FIG. 4A), but is higher than that in the low-volume print speed improvement mode (initial production priority mode) if the number of printed sheets exceeds the specific number of sheets (20 sheets in FIG. 4A).

The values of 10 sheets and 20 sheets described above are merely examples, and may change depending on the properties of the print engine 114, the allowable range of the fixing temperature of the fixing unit 1012, and the like.

Figure 4B:
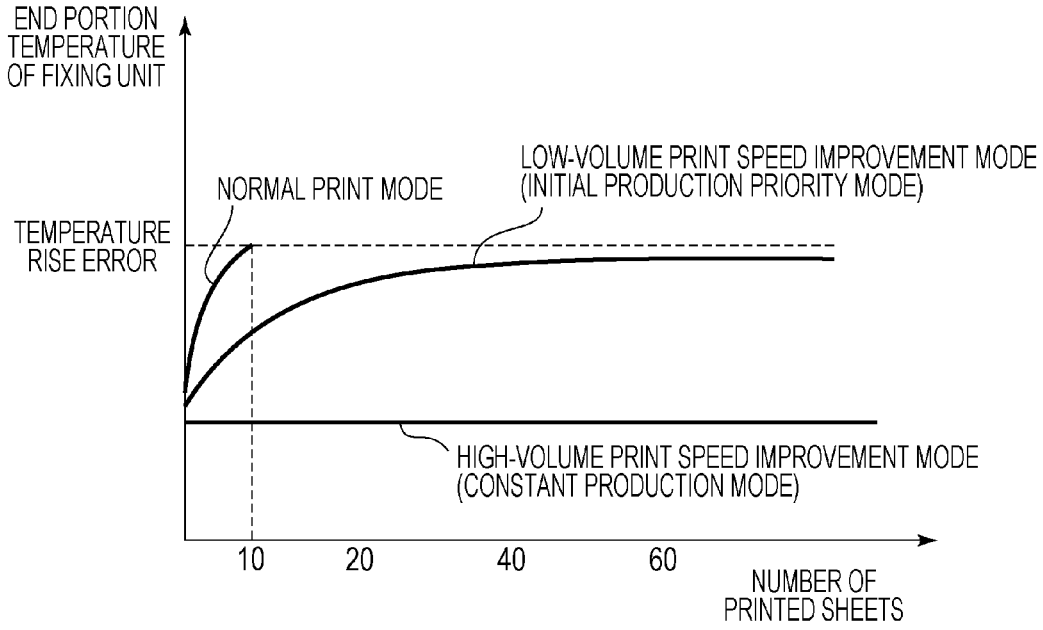
FIG. 4B is a graph indicating changes in the temperature of an end portion of a fixing unit in each print mode in a case of printing on business forms.

FIG. 4B is a graph indicating changes in the temperature of the end portion of the fixing unit 1012 in each print mode in a case of printing on business forms.

In FIG. 4B, the horizontal axis represents the number of printed sheets, and the vertical axis represents the end portion temperature of the fixing unit 1012.

In the normal print mode, printing is stopped due to an occurrence of an end portion temperature rise while printing on several sheets (10 sheets in FIG. 4B).

In the low-volume print speed improvement mode (initial production priority mode), the end portion temperature gradually approaches a threshold for the end portion temperature rise as the number of printed sheets increases; however, the end portion temperature does not reach the threshold for the end portion temperature rise.

In the high-volume print speed improvement mode (constant production mode), the end portion temperature is constant regardless of the number of printed sheets. However, this situation is applicable only to a case where the constant production mode is appropriately combined with business forms. The graph may change depending on the combination.

FIG. 5 is a table indicating characteristics of further detailed modes of the constant production mode.

In this embodiment, the high-volume print speed improvement mode (constant production mode) includes modes 1 to 10. Note that the number of included modes is not limited to 10.

In any of the modes 1 to 10, the print speed is constant regardless of the number of printed sheets. However, the level of the constant print speed differs depending on the mode, which is attained by making the process speed identical in all the modes while changing the interval between sheets depending on the mode. The target temperature of the center of the sheet passing portion is made identical in all the modes. A plurality of types of business forms having different widths are available, and the likelihood of occurrence of an end portion temperature rise differs depending on the type of business form. Accordingly, the plurality of modes are provided so as to support the widths of various types of business forms. Specifically, an end portion temperature rise is more likely to occur as the width of the business form decreases, and therefore, modes applicable to such a case are limited to those with lower print speeds.

Setting Performed in Advance

FIGS. 6A to 6G illustrate screens used to register business forms via the panel 111 of the printer 1001.

Setting is performed in advance by the administrator via the panel 111 of the printer 1001. Note that setting may be performed via the display 126 of the PC 1002 instead of the panel 111 of the printer 1001. Setting may be performed by a general user in place of the administrator.

Figure 6A:
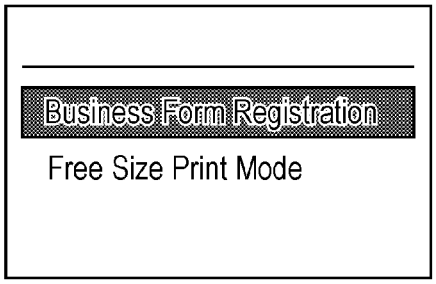
FIGS. 6A to 6G illustrate screens used to register business forms via a panel of the printer.

FIG. 6A illustrates a top screen. When "Business Form Registration" has been selected on the top screen, a screen illustrated in FIG. 6B appears. When "Free Size Print Mode" has been selected on the top screen, a screen illustrated in FIG. 6G appears.

Figure 6B:
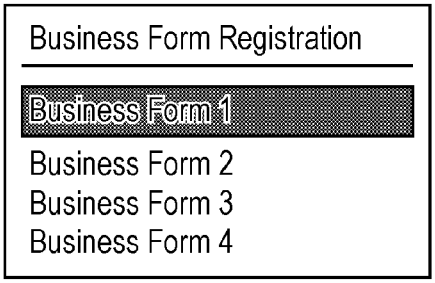

FIG. 6B illustrates a screen used to select a business form to be registered. In this example, it is assumed that registration of information on four types of business forms is made possible; however, it may be allowed to register information on any number of types of business forms other than four types. When "Business Form 1" has been selected on this screen, a screen illustrated in FIG. 6C appears. When any of "Business Form 2" to "Business Form 4" has been selected on this screen, a screen that is similar to the screen illustrated in FIG. 6C and that corresponds to the selected business form appears.

Figure 6C:
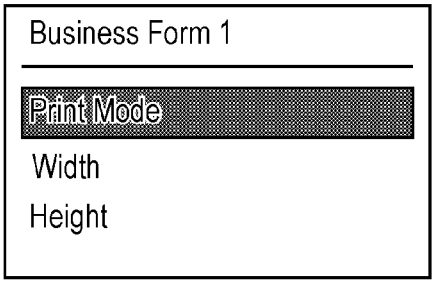

FIG. 6C illustrates a screen used to select an item to be set for the business form. When "Print Mode" has been selected on this screen, a screen illustrated in FIG. 6D appears. When "Width" has been selected on this screen, a screen illustrated in FIG. 6E appears. When "Height" has been selected on this screen, a screen illustrated in FIG. 6F appears.

Figure 6D:
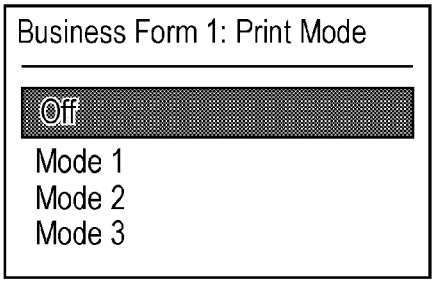
Figure 7:
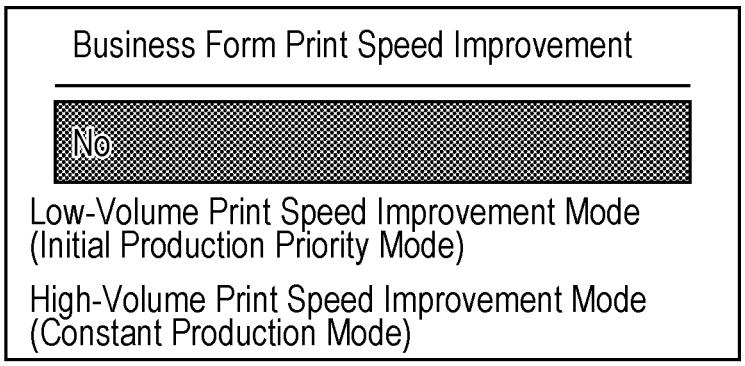
FIG. 7 illustrates a screen used to perform setting for improving the print speed for business forms via the panel of the printer.

FIG. 6D is a screen used to select a print mode to be applied when printing on the business form is performed. When "Off" has been selected on this screen, the high-volume print speed improvement mode (constant production mode) is not applied when printing on the business form is performed. In this case, a print mode that is set on a screen illustrated in FIG. 7 is applied. When any of the modes has been selected on this screen, the selected high-volume print speed improvement mode (constant production mode) is applied when printing on the business form is performed.

Figure 6E:
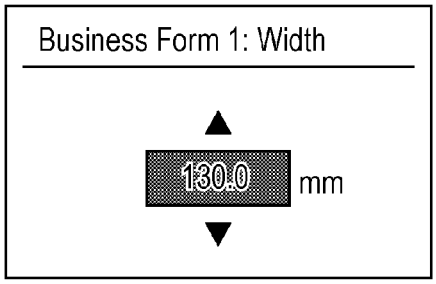

FIG. 6E illustrates a screen used to set the width of the business form. On this screen, it is possible to set the width of the selected business form by operating the up scroll button and the down scroll button or by directly inputting a numeric value.

Figure 6F:
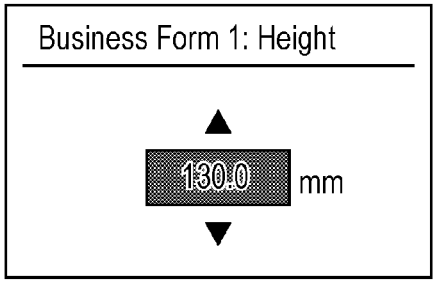

FIG. 6F illustrates a screen used to set the height of the business form. On this screen, it is possible to set the height of the selected business form by operating the up scroll button and the down scroll button or by directly inputting a numeric value.

Figure 6G:
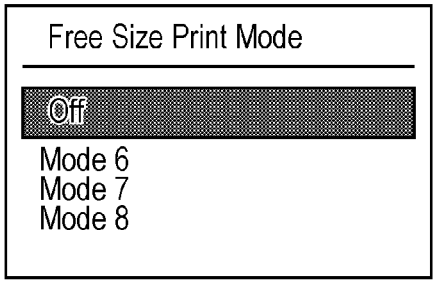

FIG. 6G illustrates a screen used to select a print mode to be applied when printing on a free-size sheet is performed. Here, "free size (universal size)" means a size to be assumed in a case where a user does not specify the sheet size at the time of printing. When "Off" has been selected on this screen, the high-volume print speed improvement mode (constant production mode) is not applied when printing on a free-size sheet is performed. In this case, a print mode that is set on the screen illustrated in FIG. 7 is applied. When any of the modes has been selected on this screen, the selected high-volume print speed improvement mode (constant production mode) is applied when printing on a free-size sheet is performed.

FIG. 7 illustrates a screen used to perform setting for improving the print speed for business forms via the panel 111 of the printer 1001.

Setting is performed in advance by the administrator via the panel 111 of the printer 1001. Note that setting may be performed via the display 126 of the PC 1002 instead of the panel 111 of the printer 1001. Setting may be performed by a general user in place of the administrator.

When "No" has been selected on this screen, the normal print mode is applied when printing on a business form is performed. When "Low-Volume Print Speed Improvement Mode (Initial Production Priority Mode)" has been selected on this screen, the low-volume print speed improvement mode (initial production priority mode) is applied when printing on a business form is performed. When "High-Volume Print Speed Improvement Mode (Constant Production Mode)" has been selected on this screen, the high-volume print speed improvement mode (constant production mode) is applied when printing on a business form is performed. In this case, a print mode set on the screen illustrated in FIG. 6D is applied.

FIG. 8 illustrates a list of settings stored in the printer 1001.

The values are stored in the HDD 117 of the printer 1001.

A width 801, a height 802, and a print mode 803 are associated with each business form and are stored. In addition to these items, a free size print mode 804 and a business form print speed improvement setting 805 are also stored.

As the width 801, a value set via the screen illustrated in FIG. 6E is stored.

As the height 802, a value set via the screen illustrated in FIG. 6F is stored.

As the print mode 803, a print mode set via the screen illustrated in FIG. 6D is stored.

As the free size print mode 804, a print mode set via the screen illustrated in FIG. 6G is stored.

As the business form print speed improvement setting 805, a print mode set via the screen illustrated in FIG. 7 is stored.

Flow of Control in PC when Printing is Performed

Figure 9:
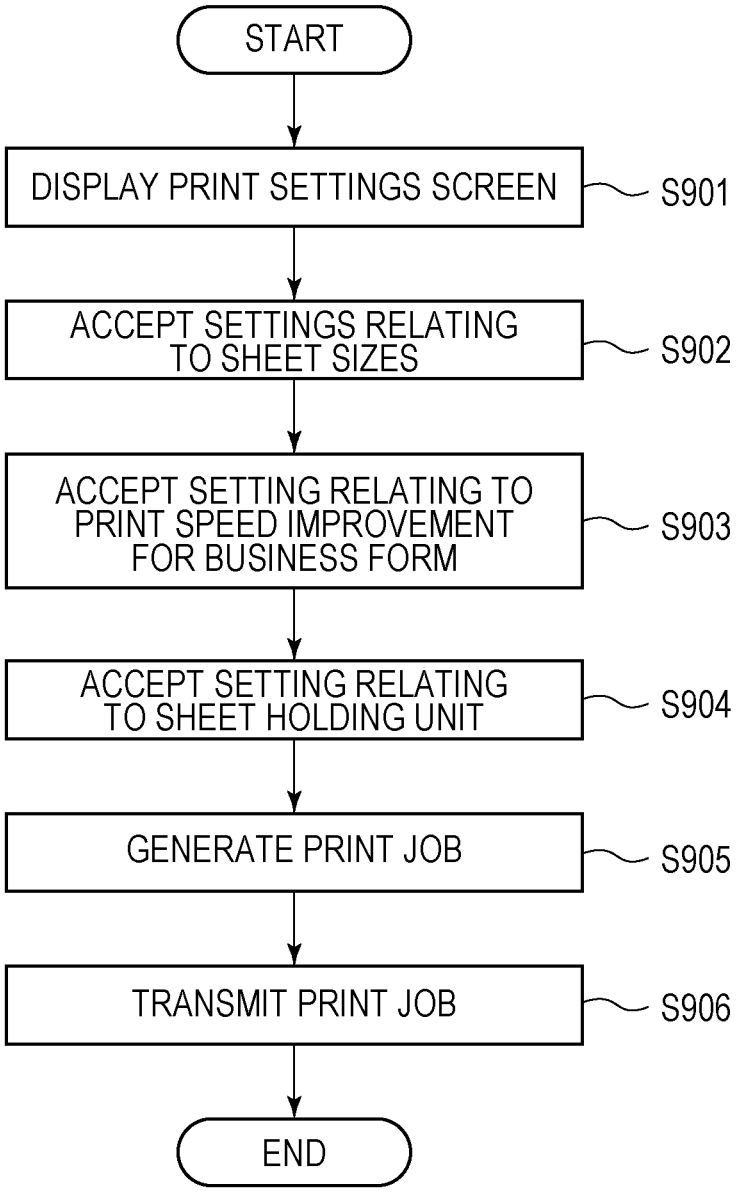
FIG. 9 is a flowchart illustrating operations performed when the PC generates a print job and transmits the print job to the printer.

FIG. 9 is a flowchart illustrating operations performed when the PC 1002 generates a print job and transmits the print job to the printer 1001.

The operations illustrated in this flowchart are implemented by the CPU 120 loading the program stored in the HDD 124 into the RAM 123 and executing the program.

The operations illustrated in this flowchart are started when a printer driver is activated after an image has been identified via the application program.

Figure 10A:
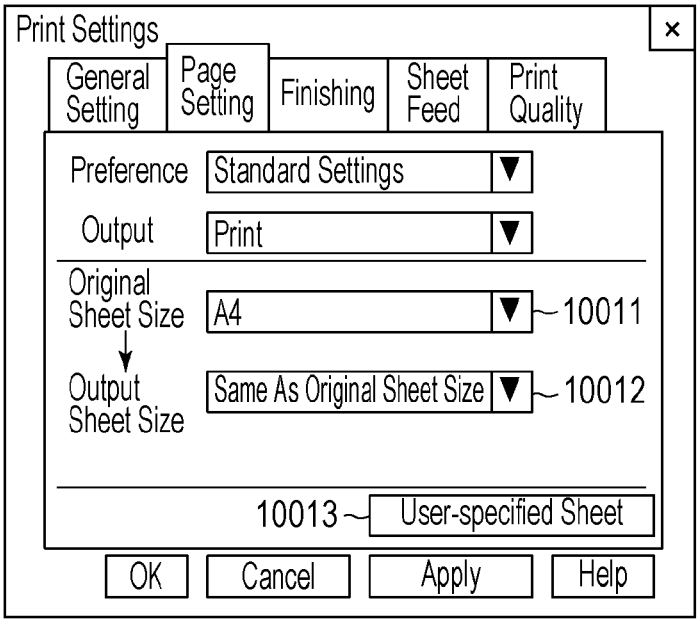
FIGS. 10A to 10E illustrate various patterns of a print settings screen for a printer driver.
Figure 10B:
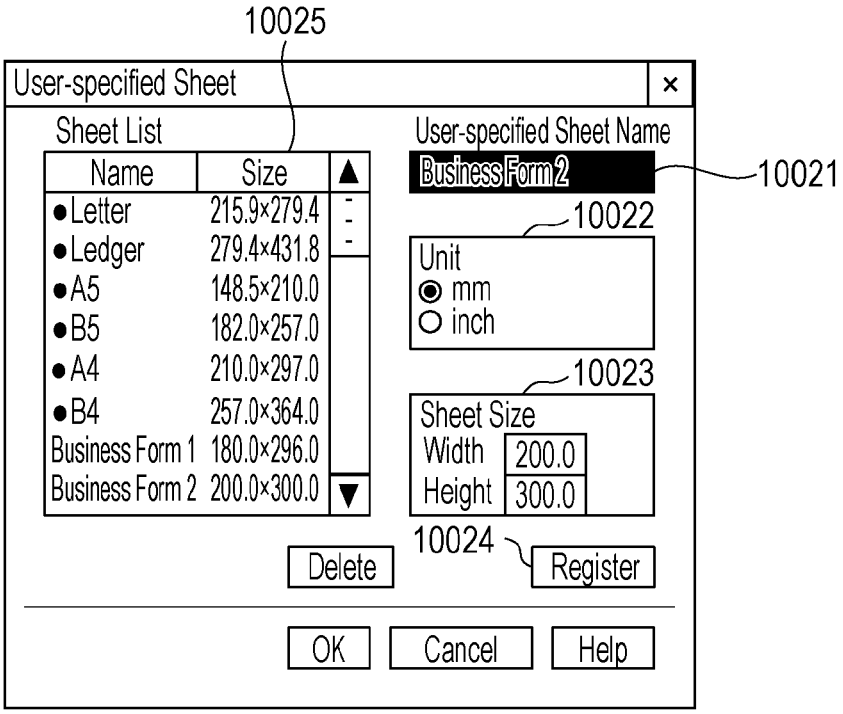
Figure 10C:
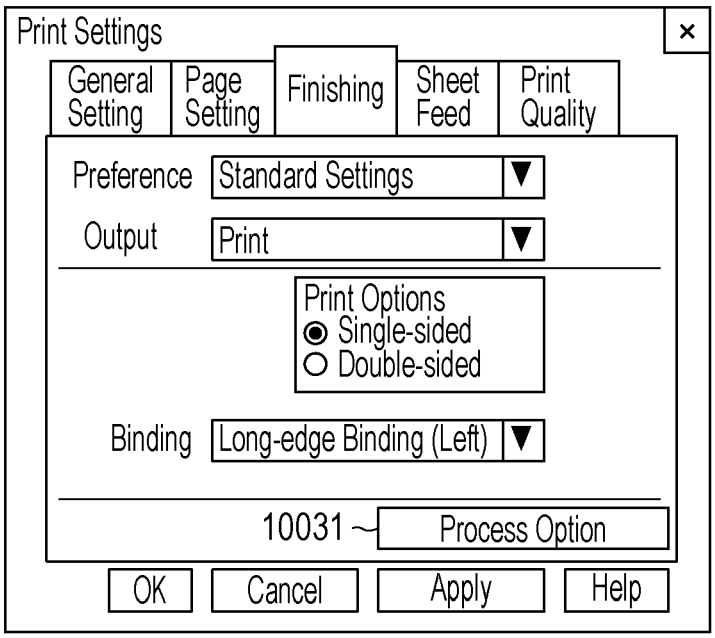

In step S901, the CPU 120 displays, on the display 126, a print settings screen for the printer driver. FIGS. 10A to 10E illustrate various patterns of the print settings screen for the printer driver. FIG. 10A illustrates a screen that appears when a "Page Setting" tab has been clicked on the print settings screen. When a "User-specified Sheet" button 10013 has been clicked on this screen, a screen illustrated in FIG. 10B appears. FIG. 10C illustrates a screen that appears when a "Finishing" tab has been clicked on the print settings screen. When a "Process Option" button 10031 has been clicked on this screen, a screen illustrated in FIG. 10D appears. FIG. 10E illustrates a screen that appears when a "Sheet Feed" tab has been clicked on the print settings screen. It is possible to accept various settings from a user via the various print settings screens described above.

In step S902, the CPU 120 accepts settings relating to sheet sizes from a user via an "Original Sheet Size" field 10011 and an "Output Sheet Size" field 10012 on the screen illustrated in FIG. 10A. Specifically, a list of sheet sizes registered in advance using the screen illustrated in FIG. 10B is displayed in the form of a pull-down menu in the "Original Sheet Size" field 10011 and the "Output Sheet Size" field 10012, and a user is able to select a desired sheet size from the list. When "Same as Original Sheet Size" has been selected in the "Output Sheet Size" field 10012, a size selected in the "Original Sheet Size" field 10011 is set as the output sheet size. When a certain sheet size, such as "A4", has been selected in the "Output Sheet Size" field 10012, the size set in the "Output Sheet Size" field 10012 is set as the output sheet size. In a case where a size selected in the "Output Sheet Size" field 10012 is different from a size selected in the "Original Sheet Size" field 10011, the image of the original document is enlarged or reduced so as to fit the size set in the "Output Sheet Size" field 10012. Note that it is possible to register in advance any user-specified sheet on the screen illustrated in FIG. 10B as described below. Specifically, a user-specified sheet is registered by inputting a sheet name in a "User-specified Sheet Name" field 10021, selecting the unit used to represent the size in a "Unit" field 10022, inputting the size of the user-specified sheet in a "Sheet Size" field 10023, and clicking a "Register" button 10024. The registered sheet appears in a "Sheet List" field 10025, via which checking or deletion of a sheet is possible.

Figure 10D:
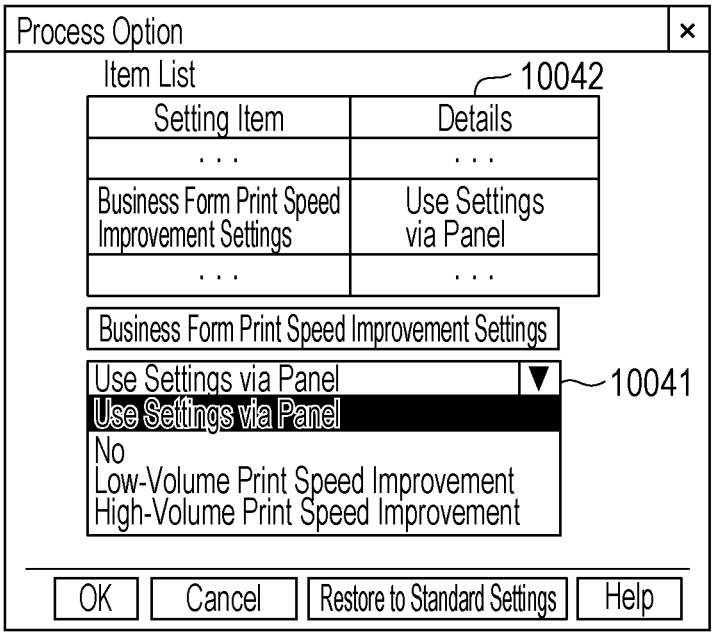
Figure 10E:
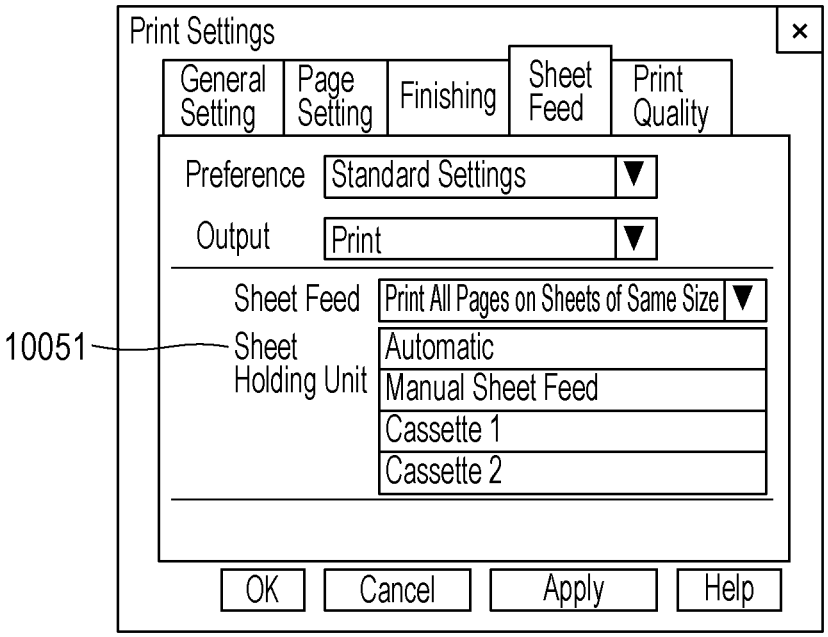

In step S903, the CPU 120 accepts a setting relating to print speed improvement for the business form in accordance with an instruction given by a user via a "Business Form Print Speed Improvement Setting" field 10041 on the screen illustrated in FIG. 10D. Specifically, in the "Business Form Print Speed Improvement Setting" field 10041, choices of "Use Settings via Panel", "No", "Low-Volume Print Speed Improvement", and "High-Volume Print Speed Improvement" appear in the form of a pull-down menu, and a user is able to select a desired print mode from among the choices. The details that have been set appear together with other process options in an "Item List" field 10042, via which checking of settings is possible.

In step S904, the CPU 120 accepts a setting relating to a sheet holding unit from a user via a "Sheet Holding Unit"

field 10051 on the screen illustrated in FIG. 10E. Specifically, a list of sheet holding units included in the printer 1001 corresponding to the printer driver appears in the "Sheet Holding Unit" field 10051, and a user is able to select a desired sheet holding unit from the list.

Figure 11:
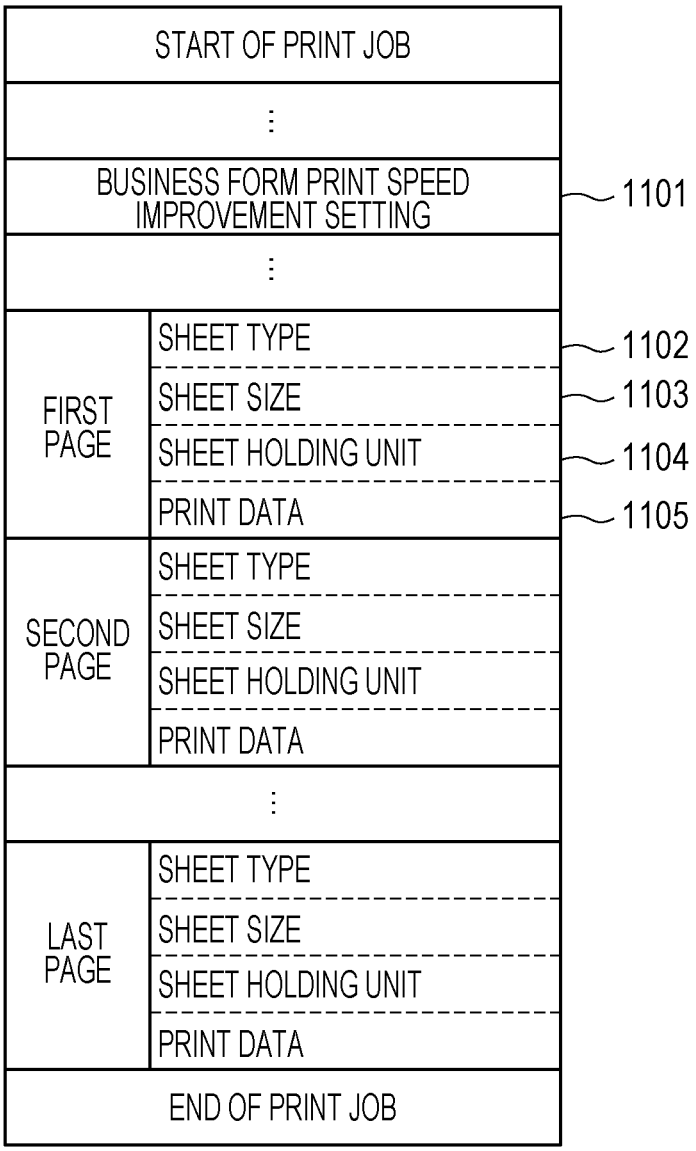
FIG. 11 is a diagram illustrating the content of a print job.

In step S905, the CPU 120 generates a print job on the basis of the image identified via the application program when the printer driver has been activated and various settings accepted in steps S902 to S904. FIG. 11 is a diagram illustrating the content of a print job. A business form print speed improvement setting 1101 represents the setting accepted in step S903. A sheet type 1102 represents the setting corresponding to the sheet name (A4 or Business Form 1, for example) among the settings accepted in step S902. A sheet size 1103 represents the setting corresponding to the sheet size (210.0×297.0 or 180.0×296.0, for example) among the settings accepted in step S902. A sheet holding unit 1104 represents the setting accepted in step S904. Print data 1105 represents the data of the image identified via the application program when the printer driver has been activated.

In step S906, the CPU 120 transmits the print job generated in step S905 to the printer 1001 via the Ethernet unit 125.

Flow of Control in Printer when Printing is Performed

Figure 12A:
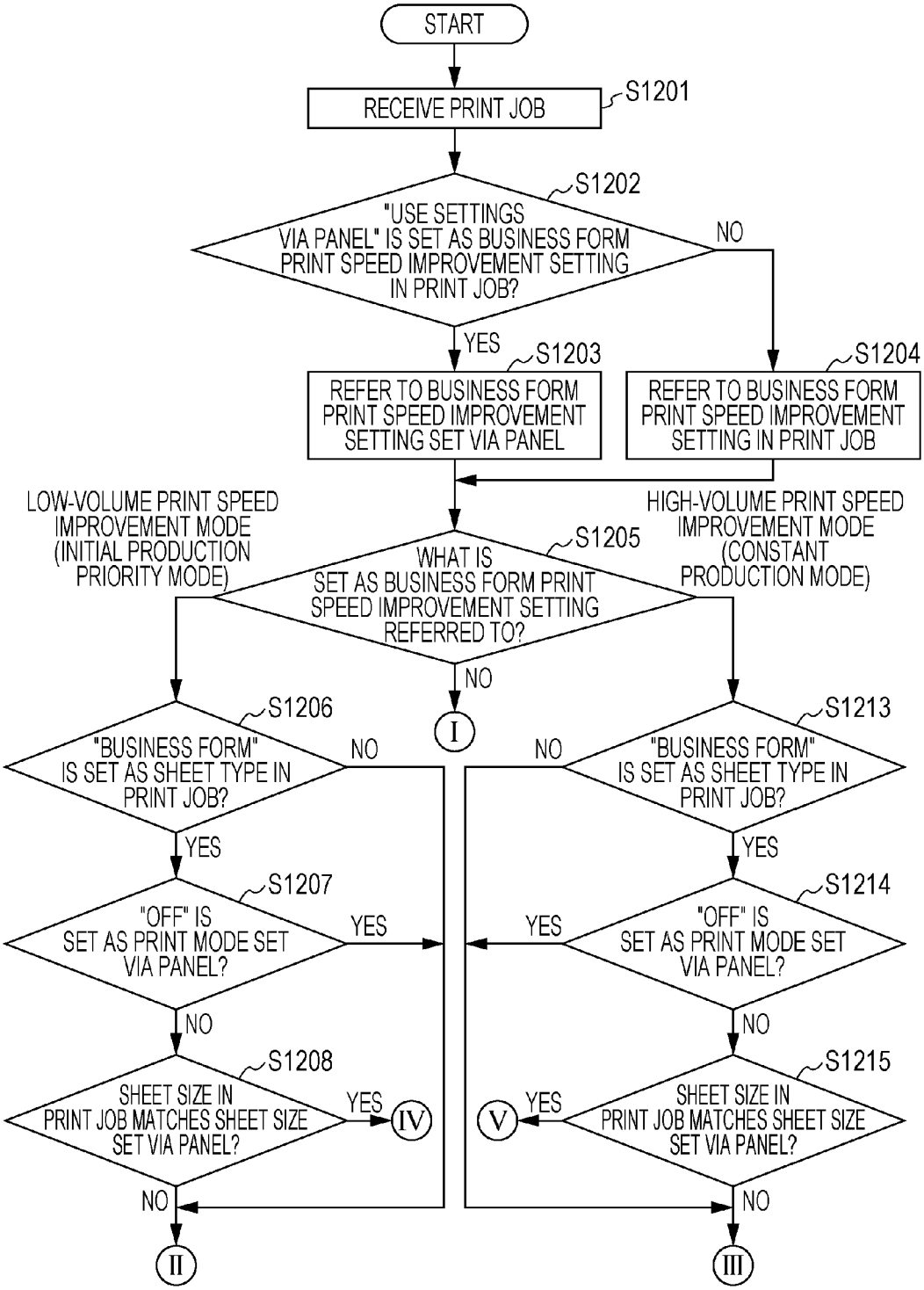
FIGS. 12A and 12B include a flowchart illustrating operations performed when the printer receives a print job from the PC and performs printing.
Figure 12B:
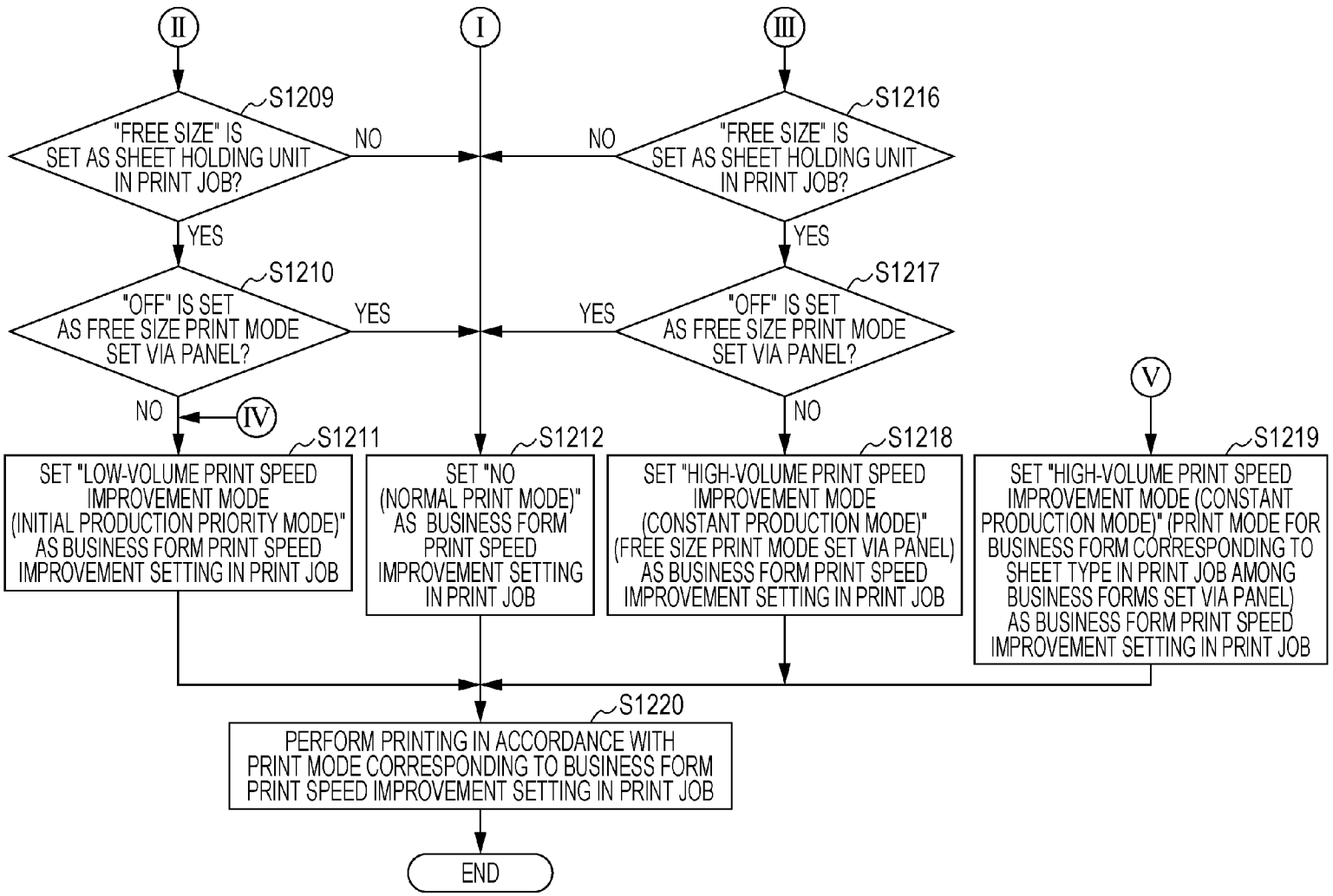

FIGS. 12A and 12B include a flowchart illustrating operations performed when the printer 1001 receives a print job from the PC 1002 and performs printing.

The operations illustrated in this flowchart are implemented by the CPU 110 loading the program stored in the HDD 117 into the RAM 116 and executing the program.

In step S1201, the CPU 110 receives the print job transmitted from the PC 1002 in step S906, via the Ethernet unit 118.

In step S1202, the CPU 110 analyzes the print job (illustrated in FIG. 11) received in step S1201 to thereby obtain the business form print speed improvement setting 1101. The CPU 110 determines whether or not "use settings via panel" is set as the business form print speed improvement setting 1101. If the result of the determination in step S1202 is "Yes", the flow proceeds to step S1203. If the result of the determination in step S1202 is "No", the flow proceeds to step S1204.

In step S1203, the CPU 110 accesses the settings (illustrated in FIG. 8) stored in advance in the HDD 117 of the printer 1001 to thereby obtain the business form print speed improvement setting 805. The CPU 110 refers to the business form print speed improvement setting 805.

In step S1204, the CPU 110 refers to the business form print speed improvement setting 1101 obtained in step S1202.

In step S1205, the CPU 110 determines what is set as the business form print speed improvement setting referred to in step 1203 or in step S1204. If "low-volume print speed improvement mode (initial production priority mode)" is set as the business form print speed improvement setting, the flow proceeds to step S1206. If "no" is set as the business form print speed improvement setting, the flow proceeds to step S1212. If "high-volume print speed improvement mode (constant production mode)" is set as the business form print speed improvement setting, the flow proceeds to step S1213.

In step S1206, the CPU 110 analyzes the print job (illustrated in FIG. 11) received in step S1201 to thereby obtain the sheet type 1102. The CPU 110 determines whether or not "business form" is set as the sheet type 1102. If the result of the determination in step S1206 is "Yes", the flow proceeds to step S1207. If the result of the determination in step S1206 is "No", the flow proceeds to step S1209.

In step S1207, the CPU 110 accesses the settings (illustrated in FIG. 8) stored in advance in the HDD 117 of the printer 1001 to thereby obtain the print mode 803 for the business form corresponding to the sheet type 1102 in the print job received in step S1201. The CPU 110 determines whether or not "off" is set as the print mode 803. If the result of the determination in step S1207 is "Yes", the flow proceeds to step S1209. If the result of the determination in step S1207 is "No", the flow proceeds to step S1208. Note that, if the CPU 110 determines in step S1202 that "use settings via panel" is not set as the business form print speed improvement setting 1101 (No in step S1202), the process in step S1207 may be omitted.

In step S1208, the CPU 110 analyzes the print job (illustrated in FIG. 11) received in step S1201 to thereby obtain the sheet size 1103. The CPU 110 accesses the settings (illustrated in FIG. 8) stored in advance in the HDD 117 of the printer 1001 to thereby obtain the width 801 and the height 802 of the business form corresponding to the sheet type 1102 in the print job received in step S1201. The CPU 110 compares the width and the height included in the sheet size 1103 with the width 801 and the height 802 respectively to thereby determine whether or not the width and the height match the width 801 and the height 802 respectively. In the determination, an error of 10 mm or less may be allowed, for example, or another value may be employed as the allowable error value. If the result of the determination in step S1208 is "Yes", the flow proceeds to step S1211. If the result of the determination in step S1208 is "No", the flow proceeds to step S1209.

In step S1209, the CPU 110 analyzes the print job (illustrated in FIG. 11) received in step S1201 to thereby obtain the sheet holding unit 1104. The CPU 110 determines whether or not "free size" is set as the sheet holding unit 1104. If the result of the determination in step S1209 is "Yes", the flow proceeds to step S1210. If the result of the determination in step S1209 is "No", the flow proceeds to step S1212.

In step S1210, the CPU 110 accesses the settings (illustrated in FIG. 8) stored in advance in the HDD 117 of the printer 1001 to thereby obtain the free size print mode 804. The CPU 110 determines whether or not "off" is set as the free size print mode 804. If the result of the determination in step S1210 is "Yes", the flow proceeds to step S1212. If the result of the determination in step S1210 is "No", the flow proceeds to step S1211.

In step S1211, the CPU 110 sets "low-volume print speed improvement mode (initial production priority mode)" as the business form print speed improvement setting 1101 included in the print job (illustrated in FIG. 11) received in step S1201. Note that, in a case where "low-volume print speed improvement mode (initial production priority mode)" has already been set as the business form print speed improvement setting 1101 at this point in time, the above-described setting need not be performed.

In step S1212, the CPU 110 sets "no (normal print mode)" as the business form print speed improvement setting 1101 included in the print job (illustrated in FIG. 11) received in step S1201. Note that, in a case where "no (normal print mode)" has already been set as the business form print speed improvement setting 1101 at this point in time, the above-described setting need not be performed.

In step S1213, the CPU 110 analyzes the print job (illustrated in FIG. 11) received in step S1201 to thereby obtain the sheet type 1102. The CPU 110 determines whether or not "business form" is set as the sheet type 1102. If the result of the determination in step S1213 is "Yes", the flow proceeds to step S1214. If the result of the determination in step S1213 is "No", the flow proceeds to step S1216.

In step S1214, the CPU 110 accesses the settings (illustrated in FIG. 8) stored in advance in the HDD 117 of the printer 1001 to thereby obtain the print mode 803 for the business form corresponding to the sheet type 1102 in the print job received in step S1201. The CPU 110 determines whether or not "off" is set as the print mode 803. If the result of the determination in step S1214 is "Yes", the flow proceeds to step S1216. If the result of the determination in step S1214 is "No", the flow proceeds to step S1215. Note that, if the CPU 110 determines in step S1202 that "use settings via panel" is not set as the business form print speed improvement setting 1101 (No in step S1202), the process in step S1214 may be omitted.

In step S1215, the CPU 110 analyzes the print job (illustrated in FIG. 11) received in step S1201 to thereby obtain the sheet size 1103. The CPU 110 accesses the settings (illustrated in FIG. 8) stored in advance in the HDD 117 of the printer 1001 to thereby obtain the width 801 and the height 802 of the business form corresponding to the sheet type 1102 in the print job received in step S1201. The CPU 110 compares the width and the height included in the sheet size 1103 with the width 801 and the height 802 respectively to thereby determine whether or not the width and the height match the width 801 and the height 802 respectively. In the determination, an error of 10 mm or less may be allowed, for example, or another value may be employed as the allowable error value. If the result of the determination in step S1215 is "Yes", the flow proceeds to step S1219. If the result of the determination in step S1215 is "No", the flow proceeds to step S1216.

In step S1216, the CPU 110 analyzes the print job (illustrated in FIG. 11) received in step S1201 to thereby obtain the sheet holding unit 1104. The CPU 110 determines whether or not "free size" is set as the sheet holding unit 1104. If the result of the determination in step S1216 is "Yes", the flow proceeds to step S1217. If the result of the determination in step S1216 is "No", the flow proceeds to step S1212.

In step S1217, the CPU 110 accesses the settings (illustrated in FIG. 8) stored in advance in the HDD 117 of the printer 1001 to thereby obtain the free size print mode 804. The CPU 110 determines whether or not "off" is set as the free size print mode 804. If the result of the determination in step S1217 is "Yes", the flow proceeds to step S1212. If the result of the determination in step S1217 is "No", the flow proceeds to step S1218.

In step S1218, the CPU 110 sets "high-volume print speed improvement mode (constant production mode)" as the business form print speed improvement setting 1101 included in the print job (illustrated in FIG. 11) received in step S1201. Note that, in a case where "high-volume print speed improvement mode (constant production mode)" has already been set as the business form print speed improvement setting 1101 at this point in time, the above-described setting need not be performed. As the constant production mode that specifies a throughput with which operations are performed, a print mode selected in setting of the free size print mode is set.

In step S1219, the CPU 110 sets "high-volume print speed improvement mode (constant production mode)" as the business form print speed improvement setting 1101 included in the print job (illustrated in FIG. 11) received in step S1201. Note that, in the case where "high-volume print speed improvement mode (constant production mode)" has already been set as the business form print speed improvement setting 1101 at this point in time, the above-described setting need not be performed. As the constant production mode that specifies a throughput with which operations are performed, a print mode registered in a business form setting in which a sheet size that matches the sheet size specified in the print job is set.

In step S1220, the CPU 110 performs printing by using the print data 1105 included in the print job (illustrated in FIG. 11) received in step S1201 in accordance with the print mode set in step S1211, S1212, S1218, or S1219.

Note that the process in steps S1206 and S1213 may be omitted.

The determination in steps S1208 and S1215 may be performed by comparing either of the widths and the heights. The determination in steps S1208 and S1215 may be performed by comparing the paper types (plain paper, thick paper, and the like), paper names, or paper brands other than the sizes, for example.

The determination in steps S1210 and S1217 may be performed on the basis of a free size print mode set in the print job received in step S1201.

While it is assumed that the process in steps S1206 to S1211 and steps S1213 to S1219 is performed for each page in a print job, the process may be performed for all pages in the print job at once. In this case, it is assumed that the print job only includes the sheet type 1102, the sheet size 1103, and the sheet holding unit 1104 corresponding to the first page, and the print mode for the first page may be applied to the second page and so on.

According to the first embodiment, even in a case where a plurality of types of narrow-width sheets are used, it is possible to make user operation less complicated when the constant production mode is used.

Second Embodiment

In the first embodiment, determination performed in order to finally determine the print mode is performed by the printer 1001.

On the other hand, in the second embodiment, determination performed in order to finally determine the print mode is performed by the PC 1002.

In this case, setting relating to FIGS. 6A to 6G, FIG. 7, and FIG. 8 may be performed by the PC 1002 before the operations illustrated in FIG. 9 are started, and the process up to step S1219 in FIG. 12B may be performed by the PC 1002 before the process in step S905 in FIG. 9. At this time, when the PC 1002 generates a print job in step S905, the PC 1002 adds data of the result of final determination of the print mode to the print job, and the printer 1001 performs printing in accordance with the print mode corresponding to the data added to the print job, in step S1220.

According to the second embodiment, the process load on the printer 1001 is reduced compared with the first embodiment when the constant production mode is used.

Third Embodiment

In the first embodiment, the PC 1002 performs print setting and generates print jobs.

On the other hand, in the third embodiment, the printer 1001 performs print setting and generates print jobs. This embodiment is applied to a situation where the printer 1001 reads a document using a scanner and prints the document or a situation where the printer 1001 prints an image stored in the HDD 117, for example.

In this case, the process illustrated in FIG. 9 may be performed by the printer 1001 before the operations illustrated in FIGS. 12A and 12B are started.

According to the third embodiment, all operations are performed only by the printing apparatus when the constant production mode is used, and therefore, users' convenience is increased compared to the first embodiment.

Other Embodiments

Embodiments of the present invention can also be realized by a computer of a system or apparatus that reads out and executes computer executable instructions recorded on a storage medium (e.g., non-transitory computer-readable storage medium) to perform the functions of one or more of the above-described embodiment(s) of the present invention, and by a method performed by the computer of the system or apparatus by, for example, reading out and executing the computer executable instructions from the storage medium to perform the functions of one or more of the above-described embodiment(s). The computer may comprise one or more of a central processing unit (CPU), micro processing unit (MPU), or other circuitry, and may include a network of separate computers or separate computer processors. The computer executable instructions may be provided to the computer, for example, from a network or the storage medium. The storage medium may include, for example, one or more of a hard disk, a random-access memory (RAM), a read only memory (ROM), a storage of distributed computing systems, an optical disk (such as a compact disc (CD), digital versatile disc (DVD), or Blu-ray Disc (BD)™), a flash memory device, a memory card, and the like.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2014-074580, filed Mar. 31, 2014, which is hereby incorporated by reference herein in its entirety.

What is claimed is:

1. A sheet conveyance apparatus comprising:

a convey unit configured to convey sheets;

an obtaining unit configured to obtain attribute information about sheets used in a job;

a determining unit configured to determine a first interval and a second interval, wherein the first interval is an interval between sheets that are conveyed by the convey unit in a case where the attribute information about the sheets obtained by the obtaining unit is first attribute information, and wherein the second interval is an interval between sheets that are conveyed by the convey unit in a case where the attribute information about the sheets obtained by the obtaining unit is second attribute information that is different from the first attribute information;

a control unit configured to perform control to make the convey unit convey sheets at the interval between sheets determined by the determining unit; and a setting unit configured to set, in accordance with an instruction given by a user, the first interval or the second interval as an interval between sheets at which sheets, fed from a predetermined sheet holding unit, are to be conveyed by the convey unit, wherein, in a case where the sheets used in the job are fed from the predetermined sheet holding unit, the determining unit performs determination to make the convey unit convey the sheets used in the job at the interval set by the setting unit.

2. The sheet conveyance apparatus according to claim 1, wherein, in a case where the sheets used in the job are nonstandard-size sheets and a sheet size obtained by the obtaining unit is a first size, the determining unit determines the first interval to be the interval between sheets that are conveyed by the convey unit, wherein, in a case where the sheets used in the job are nonstandard-size sheets and the sheet size obtained by the obtaining unit is a second size that is different from the first size, the determining unit determines the second interval to be the interval between sheets that are conveyed by the convey unit, and wherein, in a case where the sheets used in the job are standard-size sheets having a size that is other than the first size and the second size, the determining unit determines a third interval to be the interval between sheets that are conveyed by the convey unit.

3. The sheet conveyance apparatus according to claim 1, wherein the setting unit is configured to set, in accordance with an instruction given by a user, the first interval or the second interval as an interval between sheets at which sheets used in a job are to be conveyed by the convey unit, wherein attribute information about the sheets used in the job is not specified, and wherein, in a case where attribute information about the sheets used in the job is not specified, the determining unit performs determination to make the convey unit convey sheets at the interval set by the setting unit.

4. The sheet conveyance apparatus according to claim 1, wherein, in a case where the attribute information about the sheets obtained by the obtaining unit is the first attribute information, the determining unit determines a first speed to be a speed at which printing is performed by a printing unit, wherein, in a case where the attribute information about the sheets obtained by the obtaining unit is the second attribute information, the determining unit determines a second speed to be the speed at which printing is performed by the printing unit, and wherein the control unit performs control to make the printing unit perform printing at the speed determined by the determining unit.

5. The sheet conveyance apparatus according to claim 1, wherein the attribute information is information regarding a sheet size.

6. A sheet conveyance apparatus comprising:

a convey unit configured to convey sheets;

a setting unit configured to set, in accordance with an instruction given by a user, a first interval or a second interval as an interval between sheets at which sheets, fed from a predetermined sheet holding unit, are to be conveyed by the convey unit;

a determining unit configured to perform determination to make the convey unit convey sheets at the interval between sheets set by the setting unit in a case where sheets used in a job are fed from the predetermined sheet holding unit; and a control unit configured to perform control to make the convey unit convey sheets at the interval between sheets determined by the determining unit.

7. The sheet conveyance apparatus according to claim 6, wherein, in a case where a sheet size used in the job is not specified, the determining unit performs determination to make the convey unit convey sheets at the interval between sheets set by the setting unit.

8. A printing apparatus comprising:

a printing unit configured to print images on sheets;

an obtaining unit configured to obtain attribute information about sheets used in a job;

a determining unit configured to determine a speed at which the printing unit prints images on sheets, wherein, in a case where the sheets used in the job are nonstandard-size sheets and a sheet size obtained by the obtaining unit is a first size, the determining unit is configured to determine a first speed to be a speed at which the printing unit prints images on sheets, wherein, in a case where the sheets used in the job are nonstandard-size sheets and a sheet size obtained by the obtaining unit is a second size that is different from the first size, the determining unit is configured to determine a second speed to be the speed at which the printing unit prints images on sheets, and wherein, in a case where the sheets used in the job are standard-size sheets, the determining unit is configured to determine a third speed to be the speed at which the printing unit prints images on sheets; and a control unit configured to perform control to make the printing unit print images on sheets at the speed determined by the determining unit.

9. A control method for a sheet conveyance apparatus having a convey unit configured to convey sheets, the control method comprising:

obtaining attribute information about sheets used in a job;

determining a first interval and a second interval, wherein the first interval is an interval between sheets that are conveyed by the convey unit in a case where the obtained attribute information about the sheets is first attribute information; and wherein the second interval is an interval between sheets that are conveyed by the convey unit in a case where the obtained attribute information about the sheets is second attribute information that is different from the first attribute information;

performing control to make the convey unit convey sheets at the determined interval between sheets; and setting, in accordance with an instruction given by a user, the first interval or the second interval as an interval between sheets at which sheets, fed from a predetermined sheet holding unit, are to be conveyed by the convey unit, wherein, in a case where the sheets used in the job are fed from the predetermined sheet holding unit, determining includes performing determination to make the convey unit convey the sheets used in the job at the set interval.

10. A non-transitory computer readable storage medium storing a program to cause a sheet conveyance apparatus, having a convey unit configured to convey sheets, to perform control method, the control method comprising:

obtaining attribute information about sheets used in a job;

determining a first interval and a second interval, wherein the first interval is an interval between sheets that are conveyed by the convey unit in a case where the obtained attribute information about the sheets is first attribute information, and wherein the second interval is an interval between sheets that are conveyed by the convey unit in a case where the obtained attribute information about the sheets is second attribute information that is different from the first attribute information;

performing control to make the convey unit convey sheets at the determined interval between sheets; and setting, in accordance with an instruction given by a user, the first interval or the second interval as an interval between sheets at which sheets, fed from a predetermined sheet holding unit, are to be conveyed by the convey unit, wherein, in a case where the sheets used in the job are fed from the predetermined sheet holding unit, determining includes performing determination to make the convey unit convey the sheets used in the job at the set interval.

11. An image forming apparatus comprising:

an exposure unit configured to expose a photosensitive member to form an image;

a fixing unit configured to fix the image being transferred to a sheet;

a convey unit configured to convey the sheet;

a sensor configured to detect a temperature of the fixing unit;

a setting unit configured to set one mode from among a plurality of modes for each of a plurality of specific sheet types and set size information of the sheet based on a user's instruction, wherein the plurality of modes are respectively associated with a target temperature information of the fixing unit, process speed information, and information of interval between sheets, and wherein a first mode and a second mode included in the plurality of modes are the same in the target temperature information and the process speed information but different in the information of interval between sheets;

an input unit configured to input an image forming job; and a processor configured to select a mode associated with the sheet type of the image forming job based on the information set by the setting unit, to control a temperature of the fixing unit based on the target temperature information associated with the selected mode, and to control the convey unit based on the information of interval between sheets associated with the selected mode in a case where the sheet type of the image forming job is the specific sheet type.

12. The image forming apparatus according to claim 11, wherein the specific sheet type is a business form.

13. The image forming apparatus according to claim 12, wherein the processor selects a normal print mode that is different from the plurality of modes in a case where the sheet type of the image forming job is not the specific sheet type, and wherein the normal print mode is a mode which is settable to a standard sheet other than the business form.

14. The image forming apparatus according to claim 11, wherein, in a case where the sheet type of the image forming job is not the specific sheet type, the processor determines whether the sheet type of the image forming job is a free size and, in a case where the sheet type of the image forming job is determined as a free size, the processor selects either one of mode from among the plurality of modes.

15. The image forming apparatus according for claim 14, wherein the mode selected when the sheet type of the image forming job is determined as a free size is a mode set by being associating with the free size.

16. The image forming apparatus according to claim 11, wherein the processer determines whether a business form is set for the sheet type information included in the image forming job and, according to the determination, determines whether the sheet type of the image forming job is the specific sheet type.

17. The image forming apparatus according to claim 16, wherein the processor determines whether the sheet size information included in the image forming job is the same as sheet size information of the sheet set by the setting unit and, according to that determination, determines whether the sheet type of the image forming job is the specific sheet type.

18. The image forming apparatus according to claim 11, wherein the specific sheet type is nonstandard-size sheet.

19. The image forming apparatus according to claim 11, wherein the sensor detects an end portion temperature rise of the fixing unit.

* * * * *